US005782608A

United States Patent [19]

McKee

[11] Patent Number: 5,782,608

[45] Date of Patent: Jul. 21, 1998

[54] METHOD AND APPARATUS FOR CONTROLLING A PROGRESSING CAVITY WELL PUMP

[75] Inventor: Fount E. McKee, Houston, Tex.

[73] Assignee: Delta-X Corporation, Houston, Tex.

[21] Appl. No.: 725,603

[22] Filed: Oct. 3, 1996

[51] Int. Cl.[6] ..... F04B 49/00

[52] U.S. Cl. ..... 417/43; 417/44.1; 417/53

[58] Field of Search ..... 417/12, 36, 43, 417/44.1, 45, 53; 166/369, 53; 73/152.01

[56] References Cited

U.S. PATENT DOCUMENTS

| | | | |
|---|---|---|---|
| 4,076,458 | 2/1978 | Jones | 417/46 |
| 4,125,163 | 11/1978 | Fitzpatrick | 166/314 |
| 4,145,161 | 3/1979 | Skinner | 417/45 |
| 4,318,674 | 3/1982 | Goodbey et al. | 417/36 |
| 4,389,164 | 6/1983 | Godbey et al. | 417/36 |
| 4,661,751 | 4/1987 | Werner | 417/53 |
| 4,738,313 | 4/1988 | McKee | 166/372 |
| 4,854,164 | 8/1989 | Rhoads | 73/155 |
| 4,973,226 | 11/1990 | McKee . | |
| 5,044,888 | 9/1991 | Hester, II | 417/45 |
| 5,064,348 | 11/1991 | McKee et al. . | |
| 5,167,490 | 12/1992 | McKee . | |
| 5,251,696 | 10/1993 | Boone et al. | 166/250 |

*Primary Examiner*—Ayaz R. Sheikh
*Assistant Examiner*—Xuan M. Thai
*Attorney, Agent, or Firm*—Fulbright & Jaworski

[57] ABSTRACT

A method and apparatus for controlling the speed of a progressing cavity liquid well pump by driving the pump with a variable speed drive device while measuring the amount of liquid production from the pump. The speed of the pump is varied in speed steps, either upwardly or downwardly, by the variable speed drive device while measuring liquid production, to maintain a linear relationship between liquid production and pump speed.

6 Claims, 5 Drawing Sheets

METHOD AND APPARATUS FOR CONTROLLING A PROGRESSING CAVITY WELL PUMP

BACKGROUND OF THE INVENTION

The present invention is directed to controlling the pumping rate of a progressing cavity bottom hole well pump for obtaining optimum well production as well as avoiding pump-off.

Normally the pumping system capacity is in excess of the productivity rate of the oil reservoir. This results in the well being pumped dry or pumped off causing damage to the pumping system unless controlled. It is well known, as disclosed in U.S. Pat. Nos. 4,973,226; 5,064,341; and 5,167,490 to provide control systems to avoid pump-off in pumping oil from an oil well by the use of a downhole liquid pump which is actuated by a rod which in turn is reciprocated from the well surface by a prime mover.

However, in addition to the reciprocating sucker rod type of pumps, there is presently in use progressing cavity pumps (PCP) in which a rotor is rotated inside a stator for pumping liquids. The PC type pumps are advantageous because the initial cost of the installation is low as compared to reciprocating type pumps. However, the PC pump is also subject to pump-off and when pumped dry may be damaged and is expensive to repair as the pump must be removed from the well. Presently, there is no satisfactory controller on the market for solving the pump-off problem in progressing cavity or PC pumps.

The present invention is directed to a method and apparatus for controlling the pumping rate of a progressing cavity bottom hole pump while obtaining a maximum production from the well as well as avoiding damage due to pumping off.

SUMMARY

The present invention is directed to the method of controlling the speed of a progressing cavity liquid well pump for obtaining maximum liquid production without maintaining the well in the pumped off state by driving the progressing cavity well pump with a variable speed drive device while measuring the amount of liquid production produced from the well. The method includes varying the speed of the pump in speed steps, either upwardly or downwardly, by the variable speed drive device while measuring the liquid production to maintain a linear relationship between liquid production and pump speed.

Yet a further object of the present invention is the method of controlling the speed of a progressing cavity liquid well pump by driving the pump with a variable speed drive device, measuring the amount of liquid production and increasing the speed of the pump by the variable speed drive device and continuing this step so long as increasing the speed provides a proportional increase in the amount of liquid produced. However, if increasing the speed of the pump provides a less than a proportional increase in the amount of liquid produced, the method includes decreasing the speed of the pump while measuring the amount of liquid produced until a proportional decrease in the amount of liquid produced is obtained with decreases in the speed of the pump.

Still a further method of controlling the speed of a progressing cavity liquid well pump is driving the pump with a variable speed device while measuring the amount of liquid production and increasing the speed of the pump in speed steps at predetermined time intervals while measuring the liquid production so long as the increase in speed yields a proportional increase in production. When increasing the speed of the pump yields less than a proportional increase in production, the method includes reducing the speed of the pump in speed steps at predetermined time intervals while measuring the liquid production until proportional reductions in production occurs with decreases in pump speed, and continuing the steps of increasing and decreasing the speed.

Still a further object of the present invention is the provision of an apparatus for controlling the speed of a progressing cavity liquid well pump which includes a variable speed drive device connected to and driving the progressing cavity well pump and a flow meter connected to the well pump for measuring the amount of liquid produced from the well pump. A controller is connected to the flow meter for receiving measurements of the amount of liquid produced from the pump and the controller is connected to and controls the variable speed drive device for controlling the speed of the well pump. The controller increases the speed of the pump in steps so long as an increase in speeds provides a proportional increase in the amount of liquid pumped, but if an increase in speed provides less than a proportional amount of liquid pumped, the controller reduces the speed of the pump in steps until proportional reductions in the amount of liquid produced occurs. In addition, the controller continually repeats the step of the operation.

A further object of the present invention is the provision of a power transducer connected to the well pump for measuring the power supplied to the pump and the transducer is connected to the controller for limiting the power supplied to the well pump.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1:
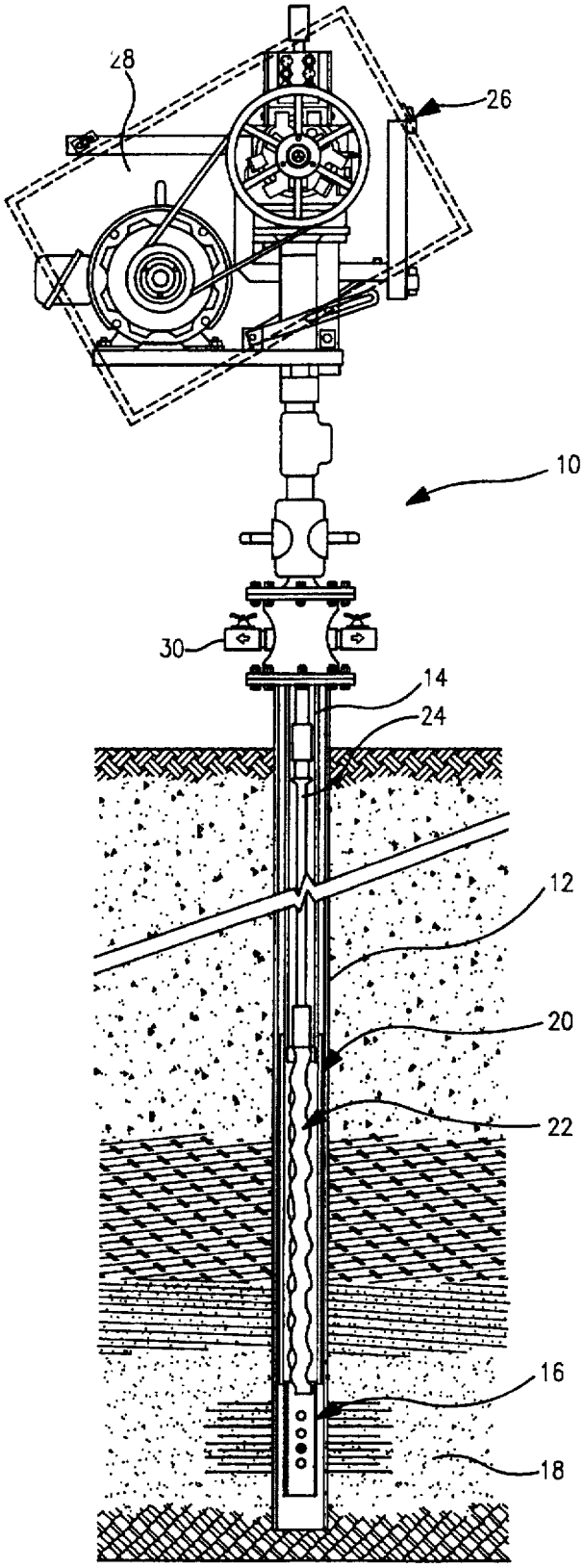
FIG. 1 is a fragmentary elevational view, partly in cross section, illustrating a conventional progressing cavity bottom hole well pump.

Referring now to the drawings, and particularly to FIG. 1, the reference numeral 10 generally indicates a conventional progressing cavity pump (PCP) such as manufactured by Griffin Pumps, Inc. of Calgary, Canada. The pump installation includes a well casing 12, well tubing 14, a tag bar 16 for admitting well liquids from a well production zone 18 into the casing 12. The pump 10 includes a stator 20 connected to the tubing 14 and a rotor 22 connected to a rotatable rod 24. When the rotor 22 is rotated inside the stator 20, cavities in the rotor 22 move axially and a continuous seal between the cavities keeps the well fluid moving upwardly into the tubing 14 at a flow rate which is directly proportional to the rotational speed of the pump 20. The rotor 22 is driven from the surface through a drive assembly 26 driven by a prime mover 28 such as a gas or electric motor. Fluid from the well flows out of the flow line outlet 30. The above installation is conventional.

Generally, all well pumps are oversized in order to obtain maximum production, but pump-off can occur when the pump removes the liquid faster than the formation 18 can replace it. Pump-off can cause expensive damage to such systems.

Figure 2:
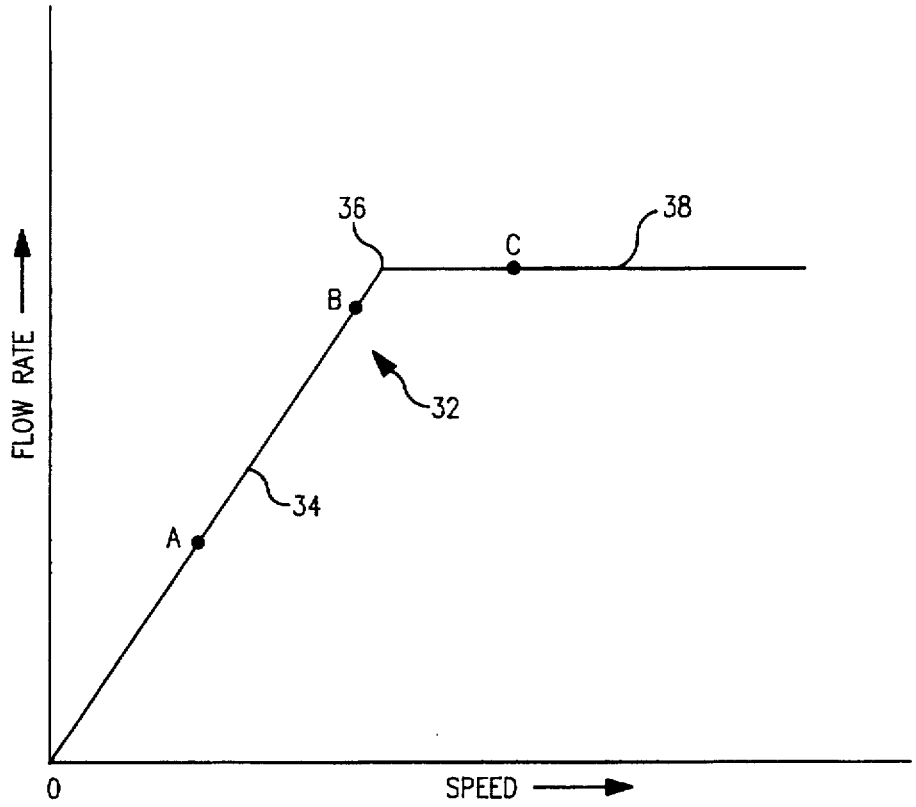
FIG. 2 is a graph of the flow rate of production from the pump of FIG. 2 versus the speed of operation of the pump illustrating the theory of the present invention.

Referring now to FIG. 2, a graph generally indicated by the reference numeral 32 is shown of the flow rate and thus the well production produced from the PC pump 10 of FIG. 1 relative to the speed of the pump 10. From the graph 32, it is noted that as the speed of the pump is increased from zero, the flow rate increases along a linearly portion 34 of the graph 32 until it reaches a "knee" 36 after which the graph includes a substantially flat portion 38 indicating that an increase in speed does not yield any further increase in well production. That is, when the pump is operating along the line 38, the well has been pumped dry and the pump is pumped off which may result in expensive damage. The pump 10 can be operated at point A on the graph 32, but such an operation does not produce the maximum amount of production from the well. Preferably, the operation should be on the linear portion 34 of the graph 32 near the knee 36, such as at point B. However, operation should not occur at point C or the well will be pumped off.

Figure 3:
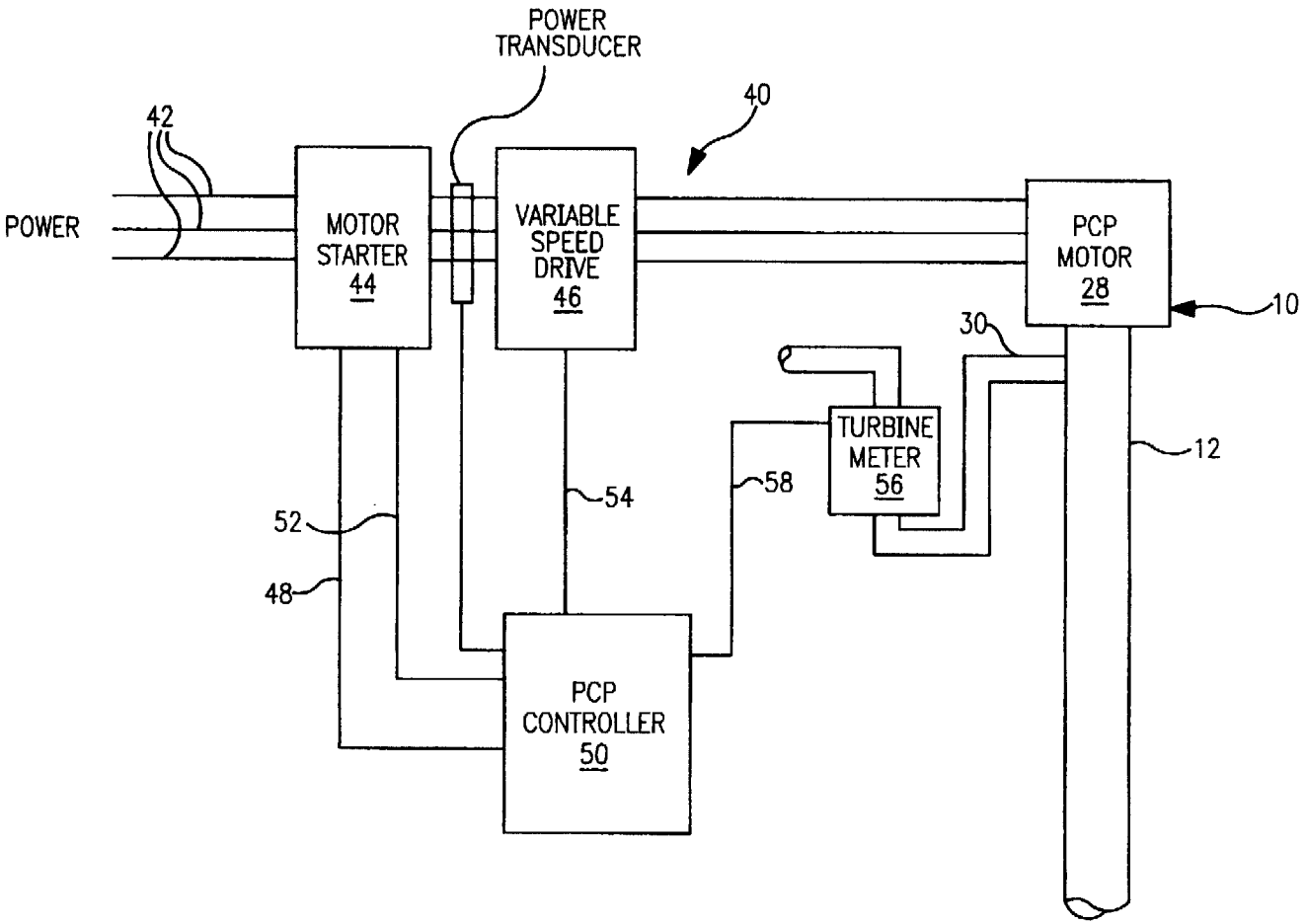
FIG. 3 is a schematic control system for controlling a positive cavity pump.

Referring now to FIG. 3, the reference numeral 40 generally indicates the preferred system for controlling a PC. Electrical power, such as three phase 480 volt electrical power is supplied to a conventional starter 44 which supplies power to a variable speed drive 46 which provides a variable frequency drive to the motor 28, such as an induction motor of the PC installation 10 for varying the speed of rotation of the rods 24 (FIG. 1). However, other types of control systems and prime movers 28 may be utilized to vary the speed of the rods 24 such as an internal combustion engine in which the speed is controlled by adjusting its throttle or by adjusting the speed ratio of a gear box. Power is supplied from the motor starter 44 through a line 48 to a PC controller 50 which contains a CPU. Also, an on-off control line 52 is provided between the motor starter 44 and the controller 50. The controller 50 provides a speed control signal 54 to the variable speed drive 46 for controlling the speed of the PC pumping unit 10. A turbine flow meter 56 is connected in the flow outlet line 30 from the pump installation 10 and thus measures the rate and amount of liquid produced by the pump 10. The turbine meter 56 transmits this measurement through pulses over line 58 to the controller 50. The controller 50 is a PC pump controller manufactured by Delta-X Corporation of Houston, Tex.

The controller 50 varies the speed of the motor 28 and thus of the pump 10 in speed steps, either upwardly or downwardly, through the variable speed drive device 46 while measuring the liquid production through the turbine meter 56 to maintain a linear relationship between the liquid production and the pump speed and thus operate the PC pump on the linear portion 34 (FIG. 2) of the graph 32. Preferably, the speed is varied to operate the pump adjacent the knee 36, such as point B, thereby providing optimum well production as well as avoiding pump-off. The controller 50 makes a change in pump 10 motor speed and looks for a proportional change in production. If an increase in speed yields less than a proportional increase in production, the well is pumping off and the controller 50 reduces the speed in steps until proportional reductions in production occur with decreases in motor speed. The controller 50 then begins increasing speed again and looks for proportional increases in production. It will continue to step up and down along the linear portion 34 of the graph 32 to the non-linear portion 38. Preferably, to filter out short term variations, the measurement computation requires three consecutive agreeing comparisons to implement a speed direction reversal (either increasing or decreasing motor speed).

Various types of computations may be made by the computer 50. One type of measurement computation is as follows:

Production Measurement Computation

1. The % increase/decrease in speed for the next sampling period is equal to the % change in production based on the current sample period production and the last sample period production.

EXAMPLE

Let: LAST_PROD=last sample period production

CURR_PROD=current sample period production

CURR_SPEED=current speed

% PROD_CHANGE=percent production change

NEW_SPEED=next sample period speed

SPD_INC_DEC=speed increase/decrease value

ABS—Absolute

Calculation:

$$\%\ \text{PROD_CHANGE} = \text{ABS}\ \frac{(\text{CURR_PROD} - \text{LAST_PROD})}{\text{LAST_PROD}} \times 100$$

$$\text{SPD_INC_DEC} = \text{CURR_SPEED} \times \frac{\%\ \text{PROD_CHANGE}}{100}$$

$$\text{NEW_SPEED} = \text{CURR_SPEED}\ (+\ \text{"or"}\ -)\ \text{SPD_INC_DEC}$$

Note: + for increase and − for decrease

2. With the basic calculation involved with this computation, the different conditions that will cause an increase, decrease or no speed change are:

2.A The speed will increase if the CURR_PROD is GREATER than LAST PROD.

2.B The speed will decrease if the CURR_PROD is LESS than LAST_PROD.

2.C No speed change if CURR_PROD is EQUAL to LAST_PROD.

Another type of measurement computation is as follows:

Knee Searching Computation

Figure 4:
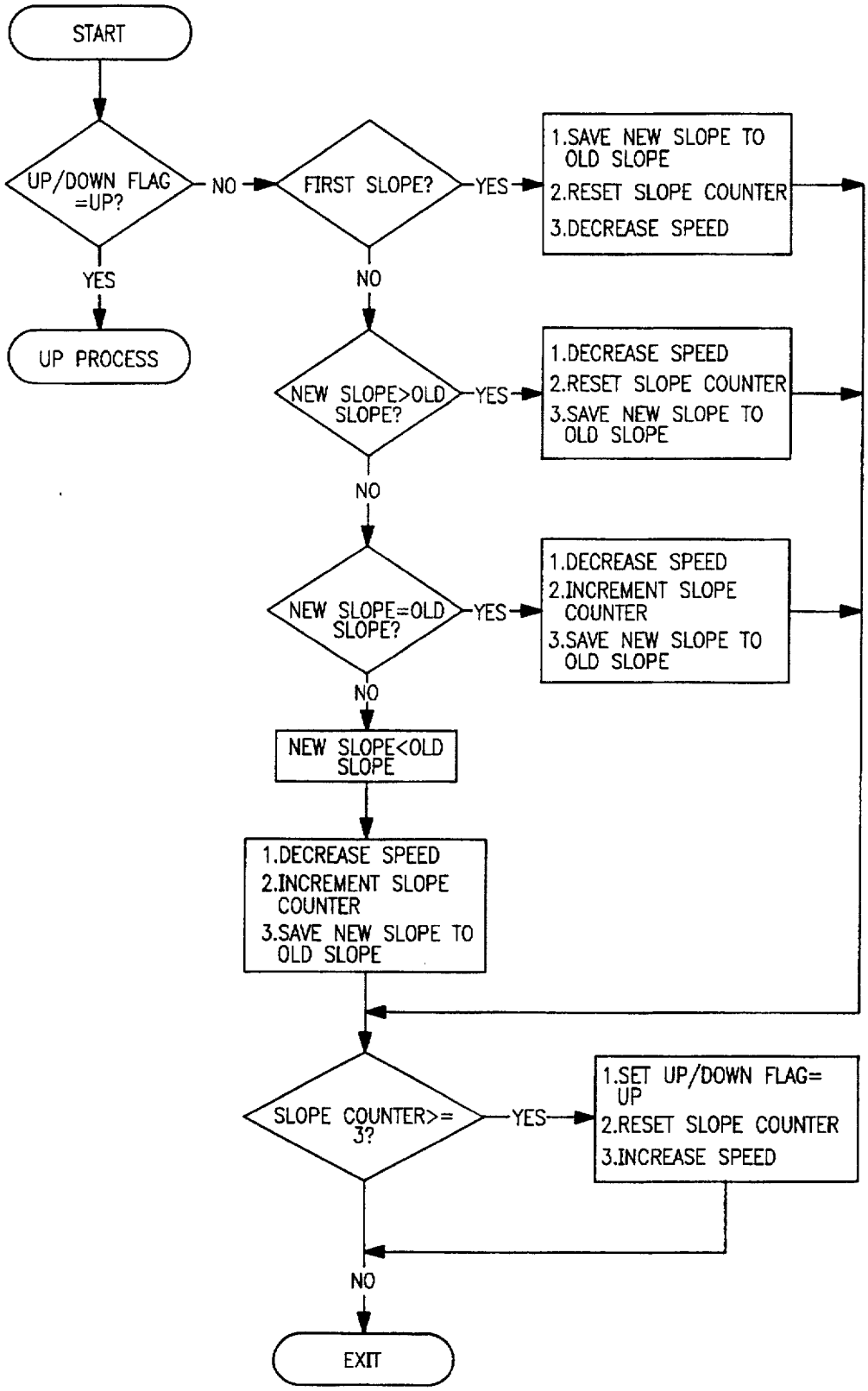
FIGS. 4–5 are logic flow diagrams of one type of control system used in the present invention.
Figure 5:
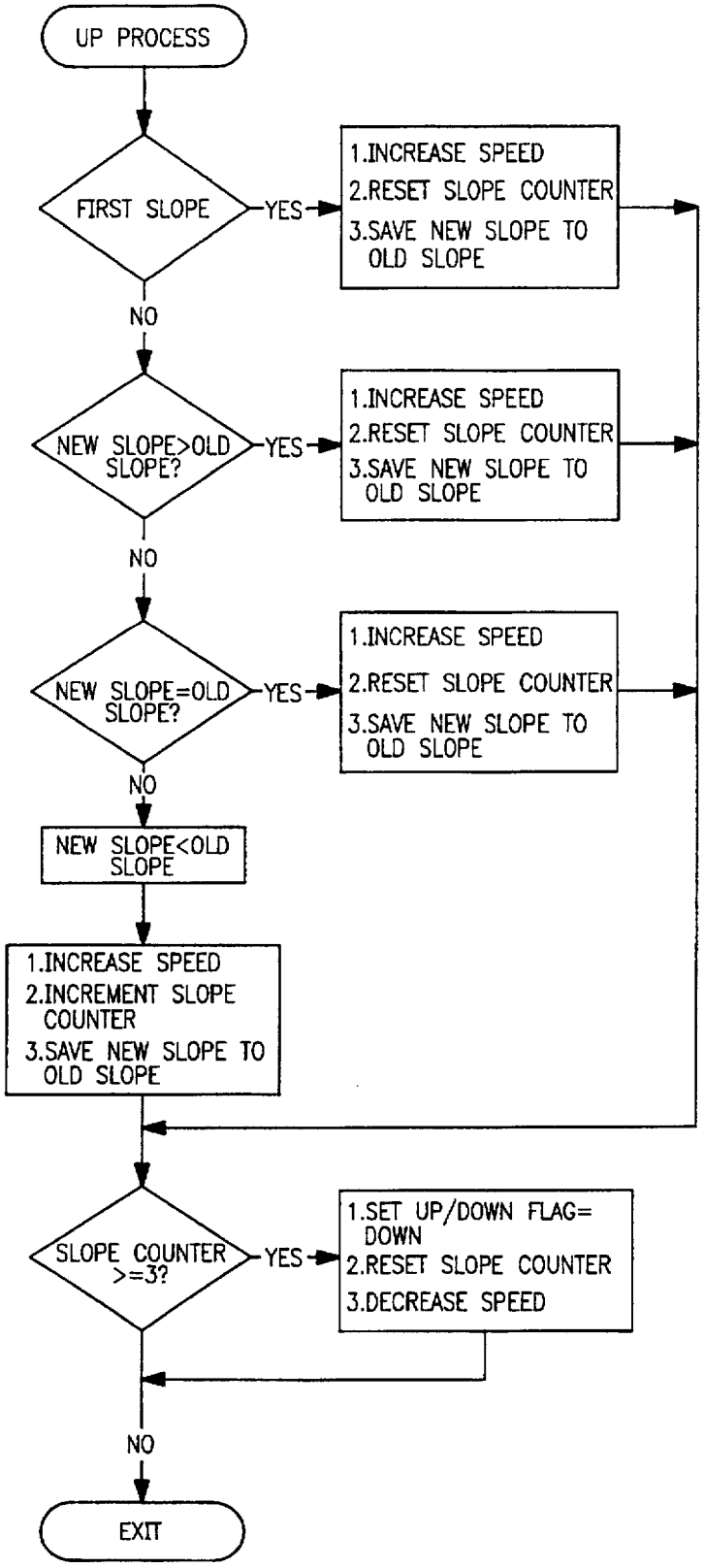

The logic flow diagram for this computation is set forth in FIGS. 4 and 5.

The definitions for the terms used in the flow diagram of FIGS. 4 and 5 are as follows:

1. NEW SLOPE=(Change in Production)/(Change in Speed)

2. OLD SLOPE=Previous sample period slope.

3. SLOPE COUNTER=Iterative variable used by the algorithm for deciding when to reverse speed (increase/decrease) direction.

4. FIRST SLOPE=is the first slope during startup process and the first slope every change in direction, that is from Going Up to Going Down Direction and vice versa.

5. UP/DOWN FLAG=Flag that states whether the system is in the increasing/decreasing speed process Referring to FIG. 4 upon start, and assuming that the UP/DOWN FLAG is in the Down position, the logic will then determine if this is the FIRST SLOPE measured in the Down position and if so will save the new slope measurement, reset the slope counter and decrease the speed. The cycle is then repeated until proportional reductions in production occur with decreases in motor speed. When this happens, the Up Flag is set and the cycling begins on the Up process in FIG. 5 which saves the new slope to the old slope, resets the slope counter and decreases speed until an increase in speed yields less than a proportional increase in production. Again, this causes the Down flag to be set and the Down process in FIG. 4 is again started.

The present invention, therefore, is well adapted to carry out the objects and attain the ends and advantages mentioned as well as others inherent therein. While a presently preferred embodiment of the invention has been given for the purpose of disclosure, numerous changes in the details of construction, arrangement of parts, and steps of the method may be made without departing from the spirit of the invention and the scope of the appended claims.

What is claimed is:

1. The method of controlling the speed of a progressing cavity liquid well pump for obtaining maximum liquid production without maintaining the well in the pumped off state comprising, continuously driving the progressing cavity well pump with a variable speed drive device while measuring the amount of liquid production produced from the well pump, and continuously varying the speed of the pump in speed steps, either upwardly or downwardly, by the variable speed drive device while measuring the liquid production, to maintain a linear relationship between liquid production and pump speed.

2. The method of controlling the speed of a progressing cavity liquid well pump comprising, driving the progressing cavity well pump with a variable speed drive device, measuring the amount of liquid production produced from the well pump, increasing the speed of the pump by the variable speed drive device while measuring the amount of liquid produced, and continuing this step so long as increasing the speed provides a proportional increase in the amount of liquid produced, if increasing the speed of the pump provides a less than a proportional increase in the amount of liquid produced, decreasing the speed of the pump while measuring the amount of liquid produced until a proportional decrease in the amount of liquid produced is obtained with decreases in the speed of the pump.

3. The method of controlling the speed of a progressing cavity liquid well pump for obtaining maximum liquid production without maintaining the well in the pumped off state comprising, driving the progressing cavity well pump with a variable speed drive device while measuring the amount of liquid production produced from the well pump, increasing the speed of the pump by the variable speed drive device in speed steps at predetermined time intervals while measuring the liquid production so long as the increase in speed yields a proportional increase in production, when increasing the speed of the pump yields less than a proportional increase in production reducing the speed of the pump in speed steps at predetermined time intervals while measuring the liquid production until proportional reduction in production occurs with decreases in pump speed, and continuing the last two steps.

4. An apparatus for controlling the speed of a progressing cavity liquid well pump comprising, a variable speed drive device connected to and driving the progressing cavity well pump, a flow meter connected to the well pump for measuring the amount of liquid produced from the well pump, and a controller connected to the flow meter for receiving measurements of the amount of liquid produced from the pump said controller connected to and controlling the variable speed drive device for controlling the speed of the well pump, said controller increasing the speed of the well pump in steps so long as an increase in speeds provides a proportional increase in the amount of liquid pumped, but if an increase in speed provides less than a proportional amount of liquid pumped the controller reduces the speed of the pump in steps until proportional reductions in the amount of liquid produced occurs.

5. The apparatus of claim 4 wherein the controller continually repeats the steps of operation.

6. The apparatus of claim 4 including a power transducer connected to the well pump for measuring the power supplied to the pump, said transducer connected to the controller for limiting the power supplied to the well pump.

* * * * *